US007083452B2

(12) United States Patent
Eriksson et al.

(10) Patent No.: US 7,083,452 B2
(45) Date of Patent: Aug. 1, 2006

(54) DEVICE AND A METHOD FOR ELECTRICAL COUPLING

(75) Inventors: Klas Eriksson, Asker (NO); Svein Håheim, Oslo (NO); Jacob G. Hoseth, Averoey (NO); Peder Hansson, Jar (NO); Sohrab Yaghmai, Oslo (NO)

(73) Assignee: Vetco Gray Controls Limited, Bristol (GB)

( * ) Notice: Subject to any disclaimer, the term of this patent is extended or adjusted under 35 U.S.C. 154(b) by 0 days.

(21) Appl. No.: 10/495,333

(22) PCT Filed: Nov. 12, 2002

(86) PCT No.: PCT/IB02/04718

§ 371 (c)(1),
(2), (4) Date: Nov. 9, 2004

(87) PCT Pub. No.: WO03/042499

PCT Pub. Date: May 22, 2003

(65) Prior Publication Data

US 2005/0070143 A1 Mar. 31, 2005

(51) Int. Cl.
*H01R 4/60* (2006.01)

(52) U.S. Cl. ..... 439/194

(58) Field of Classification Search ..... 439/194, 439/190–193, 271–275, 587
See application file for complete search history.

(56) References Cited

U.S. PATENT DOCUMENTS

| | | | | |
|---|---|---|---|---|
| 2,379,800 | A * | 7/1945 | Hare | 336/105 |
| 4,605,268 | A * | 8/1986 | Meador | 439/194 |
| 5,052,941 | A * | 10/1991 | Hernandez-Marti et al. | 439/194 |
| 6,945,802 | B1 * | 9/2005 | Hall et al. | 439/194 |

FOREIGN PATENT DOCUMENTS

| | | | |
|---|---|---|---|
| DE | 19621003 | A1 | 11/1997 |
| EP | 0399987 | A1 | 11/1990 |
| GB | 1557863 | A | 12/1979 |
| JP | 7014730 | | 1/1995 |

* cited by examiner

*Primary Examiner*—J. F. Duverne
(74) *Attorney, Agent, or Firm*—Venable LLP; Eric J. Franklin

(57) ABSTRACT

A device for electrical coupling between a first and a second pipe section mechanically coupled to each other and forming a pipe adapted for transportation of a fluid. The first pipe section includes a first electric winding and the second pipe section includes a second electric winding. The first and second windings are adapted for inductive coupling between the first and the second pipe section.

15 Claims, 3 Drawing Sheets

DEVICE AND A METHOD FOR ELECTRICAL COUPLING

FIELD OF THE INVENTION

The present invention relates to a device for achieving electrical coupling between a first and a second pipe section mechanically coupled to each other and forming a pipe adapted for transportation of a fluid. The invention also relates to the use of such a device in an oil or gas well.

The invention further relates to a method for transferring electric power and/or sensor signals between a first and a second pipe section mechanically coupled to each other and forming a pipe adapted for transportation of a fluid.

The device and method are particularly suitable for downhole applications in any oil field, off-shore as well as on land, including multilateral wells with chokes or instrumentation in the branches.

PRIOR ART

A well for production of oil and/or gas typically comprises two concentric pipes, an outer pipe (production casing) and an inner pipe (production tubing). A fluid, typically oil mixed with water, gas and sand, flows from a lower part of the well through the inner pipe towards the top of the well. The fluids from several wells are then gathered in one pipeline for further transportation to a separator for separating oil, gas, water and sand. The well is may be vertical, inclined or with a horizontal section, and may also include branches in a transverse direction.

Instrumentation, such as sensors and low-power devices for monitoring well conditions during the production of oil and gas, are commonly mounted in the annular space between the outer and the inner pipe, carried by the inner pipe. The well instrumentation includes for example pressure transmitters, temperature transmitters, flow rate meters, densitometers and water cut meters. Signals to and from the instrumentation in the lower part of the well need to be transferred to the top of the well and power supply to the instrumentation needs to be transferred from the top part to the lower part of the well. Accordingly, electrical wires are needed between the lower part and the top part of the well. This is not a is problem as long as the inner pipe consists of one pipe section. The wires needed are then mounted in the volume defined between the outer and the inner pipe.

A problem of conveying power and signals arises when the pipe comprises two or more pipe sections mechanically coupled to each other and it is desired to install instrumentation in the lower part of the well. An inner pipe having a first and a second pipe section is usually installed in two passes. The first pipe section is installed in the lower part of the well in the first installation pass. The topmost end part of the first installed section usually comprises means for mechanical coupling to the next section. In downhole applications the mechanical coupling usually comprises a so called "Polished Bore Receptacle (PBR)" and a corresponding part called a seal stinger. The PBR is arranged at the topmost end of the first pipe section and the seal stinger is arranged at the lower end of the second pipe section. During the next pass of the installation, the second pipe section is installed and the lower end part of the second pipe section is brought into contact with the upper end part of the first pipe section and seals against it by means of mechanical coupling.

Since it is desirable to maximize the inner bore of the seal stinger for a given casing size, the space between the inner and the outer pipes is narrow. It is thus difficult to penetrate it with the necessary electrical wiring for the well instrumentation installed in the lower part of the well. Another difficulty arising in connection with coupling of electrical power and signals between pipe sections comprising a PBR and seal stem is that the axial positioning of the pipe sections relative to each other may easily vary within +/− 1 meter. At present if well instrumentation is to be installed in the lower part of is the well, the whole pipe has to be installed in one pass, as there is no way for making electrical connections between two pipe sections downhole. It is desirable to be able to install the pipe sections in several operations and maintain connection with coupling of electrical power and signals between said sections to instrumentation in the lower part of the well, or in the lateral branches.

SUMMARY OF THE INVENTION

The object of the present invention is to provide a device for achieving electrical coupling between a first and a second pipe section mechanically coupled to each other, which makes it possible to transmit electric power and/or signals between electrical equipment in a first part of a wellbore and electrical equipment in a second part of the wellbore.

This object is achieved by means of the initially defined device, characterized in that the first pipe section comprises a first electric winding and the second pipe section comprises a second electric winding and said first and second windings are adapted for inductive coupling between the first and the second pipe section. Since the electrical coupling is achieved with inductive coupling between the pipe sections no electrical wire or conventional electrical coupler connection is required. In a preferred embodiment of the invention, said pipe is adapted for transportation of oil and/or gas in a wellbore.

According to an embodiment of the invention the second pipe section comprises an end part adapted for mechanical coupling to the first pipe section and the first pipe section comprises an end part adapted for receiving said end part of the second pipe section, and that the first electrical winding is arranged at is said end part of the first pipe section and the second electrical winding is arranged at said end part of the second pipe section. Thanks to the fact that the windings are arranged in connection with the mechanical coupling of the pipe sections, the sections are electrically coupled to each other during the mechanical installation of the pipe sections to each other. No further step will be needed during the installation for achieving the electrical coupling between the pipe sections.

According to a further embodiment of the invention, the first and the second windings are arranged so that they at least partially overlap each other when the first and the second pipe section are mechanically coupled to each other. With such an arrangement the inductive coupling between the windings will be improved.

According to a further embodiment of the invention the diameter of the end part of the first pipe section is larger than the end part of the second pipe section and the first winding is arranged on the inside of the end part of the first pipe section and the second winding is arranged on the outside of the end part of the second pipe section. Alternatively, the diameter of the of the end part of the first pipe section is less than the end part of the second pipe section and the first winding is arranged on the outside of the end part of the first pipe section and the second winding is arranged on the inside of the end part of the second pipe section. With such an arrangement the distance between the windings becomes small and thus the inductive coupling between the windings will be improved. Another advantage with this arrangement is that the windings are easily mounted.

According to a further embodiment of the invention one of the windings has an essentially longer axial extension than the other winding. Accordingly, there will be an overlap between the two windings regardless of minor differences in the axial positioning between pipe sections. Preferably, the length of the axial extension of the longer winding is substantially corresponding to the axial positioning tolerance for the mechanical coupling between the first and the second pipe section. The length of the axial extension of the second winding is preferably in the interval 1–6 m. For example the longer winding can be located on the outside of the end part of the second pipe section, and the shorter winding can be located on the inside of the end part of the first pipe section. Alternatively, the longer winding can be located on the inside of the end part of the first pipe section and the shorter winding can be located on the outside of the end part of the second pipe section.

According to a further embodiment of the invention at least one of the first and the second winding is recessed into the wall of the end part of any of the first or the second pipe section. Thus, the windings are not taking up any extra space and the device will become compact. Furthermore, the windings can be protected from damage during installation of the pipes by covering them with a protective steel cover.

According to a further embodiment of the invention the first and the second winding are insulated to minimize the influence of radiated fields at higher frequencies.

According to a further embodiment of the invention the device is adapted for transferring electric power between the first and the second pipe section. Preferably, the device is also adapted for transferring signals between the first and the second pipe section for monitoring and/or controlling the condition in the lower part of the well.

Another object of the present invention is to provide a method for transferring electric power and/or sensor signals between a first and a second pipe section mechanically coupled to each other and forming a pipe adapted for transportation of a fluid. This object is achieved by transferring alternating current between a first and a second pipe section by means of an inductive coupling.

According to an embodiment of the invention the sensor signals are transferred by means of a high frequency carrier superimposed upon the electric power transmission.

BRIEF DESCRIPTION OF THE DRAWINGS

The invention will now be explained more closely by the description of different embodiments thereof and with reference to the appended drawings.

DETAILED DESCRIPTION OF PREFERRED EMBODIMENTS OF THE INVENTION

Figure 1:
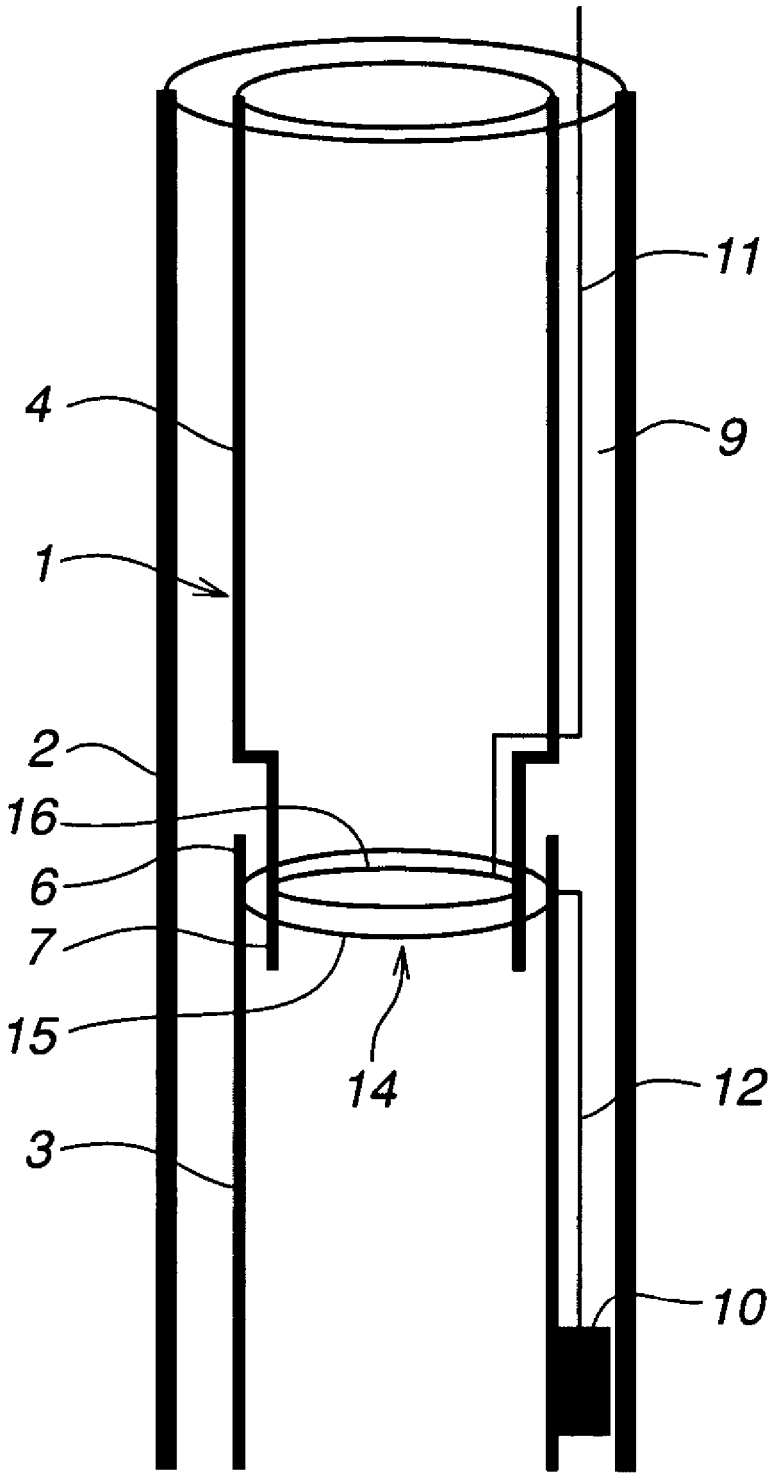
FIG. 1 schematically shows the principle of operation of the inductive coupling device according to the invention.

FIG. 1 shows a sub sea well for production of oil and/or gas comprising two concentric pipes, an inner pipe 1, called a production tubing, and an outer pipe 2, called a production casing, surrounding the inner pipe 1. The inner pipe 1 comprises a first pipe section 3 and a second pipe section 4 arranged on top of the first pipe section 3. The first pipe section 3 comprises an upper end part 6 adapted for mechanical coupling to a lower end part 7 of the second pipe section 4. The end part 7 of the second pipe section is tapering, and has a smaller diameter than the remaining of the pipe section 4, and forming a so called seal stinger. The end part 6 of the first pipe section 3 has a larger diameter than the end part 7 of the second end section 4. The end part 6 is adapted for receiving the end part 7 and thus achieving a mechanical coupling between the pipe sections. The end part 6 forms a so called "Polished Bore Receptacle" (PBR), corresponding to the seal stinger. When the end part 7 is landed in the end part 6, the end parts 6, 7, at least partially, overlap each other.

The outer pipe 2 encloses the inner pipe 1 and defines an annular path 9 between itself and the inner pipe 1. A sensor 10, for monitoring well conditions during the production of oil, is positioned in the annular path 9 at a level below the mechanical coupling of the pipe sections in the lower part of the well. The sensor is for example a pressure transmitter, a temperature transmitter, a flow rate meter, a densitometers or a water cut meter. The sensor 10 sends signals to and receives signals and power from a control and supervision equipment situated at distance from the well and is not shown in the figure. The control and power supply equipment is connected to a first electrical wire 11 arranged in the annual path 9 above the mechanical coupling of the pipe sections. The sensor 10 is connected to a second electrical wire 12.

The first and the second electrical 11, 12 wire are connected to each other by means of an inductive coupler 14 comprising a first winding 15 and a second winding. The first electrical wire 11 is connected to second the winding 16 and the second wire 12 is connected to the first winding 15. The first winding 15 is arranged in the end part 6 of the first pipe section 3 and second winding 16 is arranged in the end part 7 of the second pipe section 4. Thus, the mechanical coupler 6, 7 comprises the inductive coupler 13.

Electrical power is transferred to the sensor 10 situated in the lower level of the well, by sending alternating current, for example 50 Hz, to the second winding 16 via the first electrical wire 11. At least a portion of the alternating current is coupled to the first winding 15 by induction and the induced current is sent to the sensor 10 via the second electrical wire 12 connected between the sensor 10 and the first winding 15. In the same way, signals from the sensor 10 is transferred to the control equipment via the inductive coupler 14. The signals from the sensors are transferred via a frequency carrier, i.e. by superimposing a medium frequency signal (e.g. 50 kHz) on the low frequency power transmission (e.g. 50 Hz), and conveying data by suitably modulating this medium frequency carrier signal. Such inductive coupler can thus transfer both power and signals. The efficiency is lower than in a conventional transformer but sufficient power and signaling can be transferred for low-power devices and sensors with limited bandwidth requirements.

Figure 2:
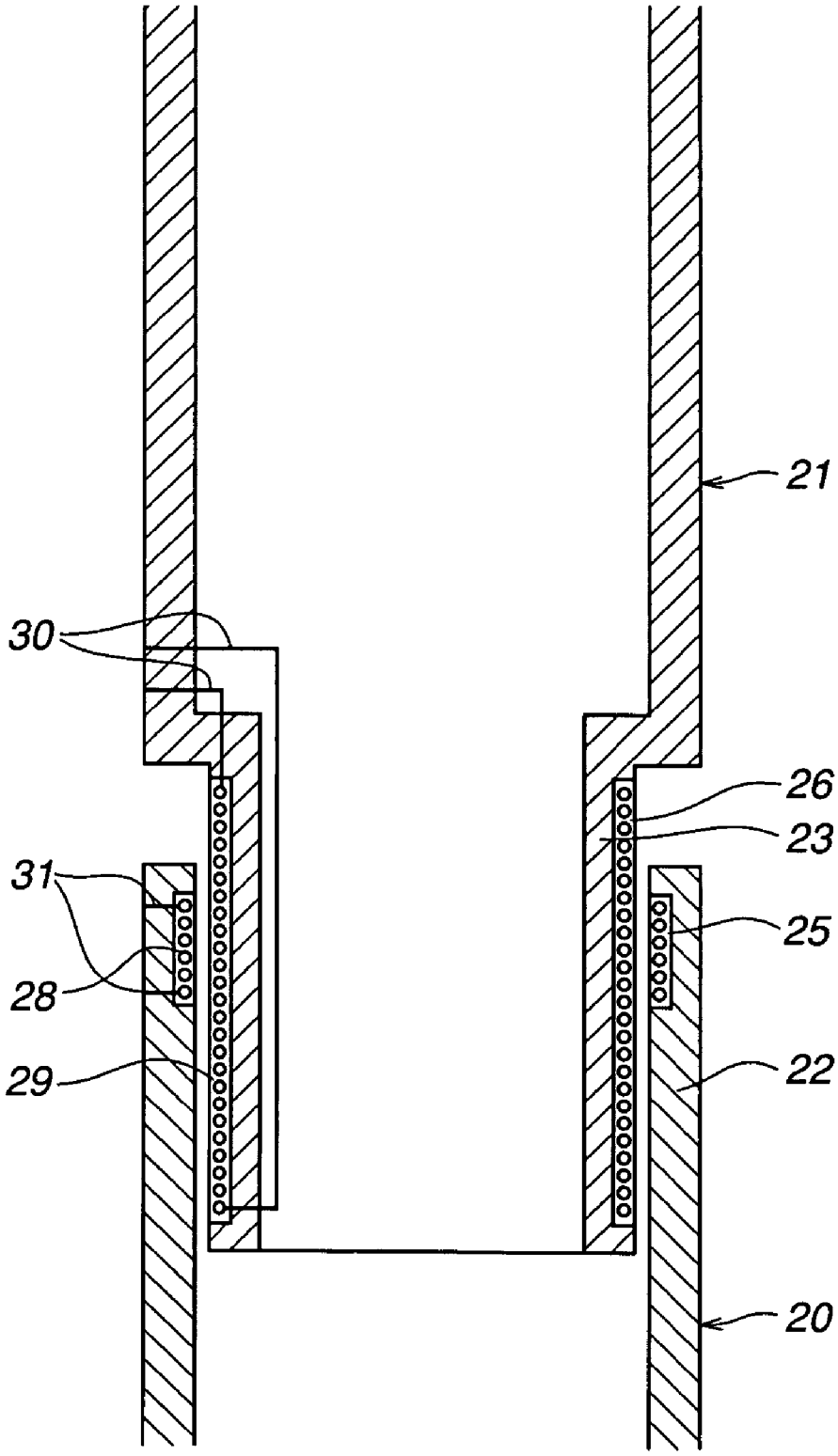
FIG. 2 shows a first embodiment of a device according to the invention for electrical coupling between a first and a second pipe section.

FIG. 2 shows a pipe having an inductive coupler according to a first embodiment of the invention. The pipe comprises a first pipe section 20 and a second pipe section 21 made of steel. The first pipe section has an end part 22 adapted for receiving an end part 23 of the second pipe section and sealing against it so that an mechanical coupling is formed between the pipe sections. The mechanical coupling comprises a conventional down hole polished bore receptacle and a seal stinger. The end part 23 of the second pipe section has a smaller diameter than the end part 22 of the first pipe section and the outer wall of the end (part 23 is facing the inner wall of the end part 22 when they are mechanically coupled to each other. The radial clearance between the end part 22 and 23 is approximately 5 mm.

A short winding 25 is arranged on the inside of the end part 22 of the first pipe section 20. The winding 25 is in the order of 0.05–0.2 m, e.g. 0.1 m. A long winding 26 is arranged on the outside of the end part 23 of the second pipe section 21. The length of the winding is corresponding to the expected axial positioning tolerance, e.g. if the tolerance is within +/− 1 m the winding is 2 m long. Thus, there will be an overlap between the two windings regardless of the axial positioning. The windings 25 and 26 are recessed into the walls of the end parts 22 and 23 and covered by a protective steel cover 28 and 29, in order to protect against damage. The windings are insulated to minimize the influence of radiated fields at higher frequencies.

Power and signals are sent to and from the second winding 26 through electrical wires 30 connected to the second winding 26. The power and signals are inductively coupled between the windings 25, 26 and are transferred to and from the first winding 25 through electrical wires 31 connected to the first winding 25. Signals and electrical power are coupled between the windings 25 and 26 by induction using the end parts 22, 23 of the steel pipe sections as transformer core.

Figure 3:
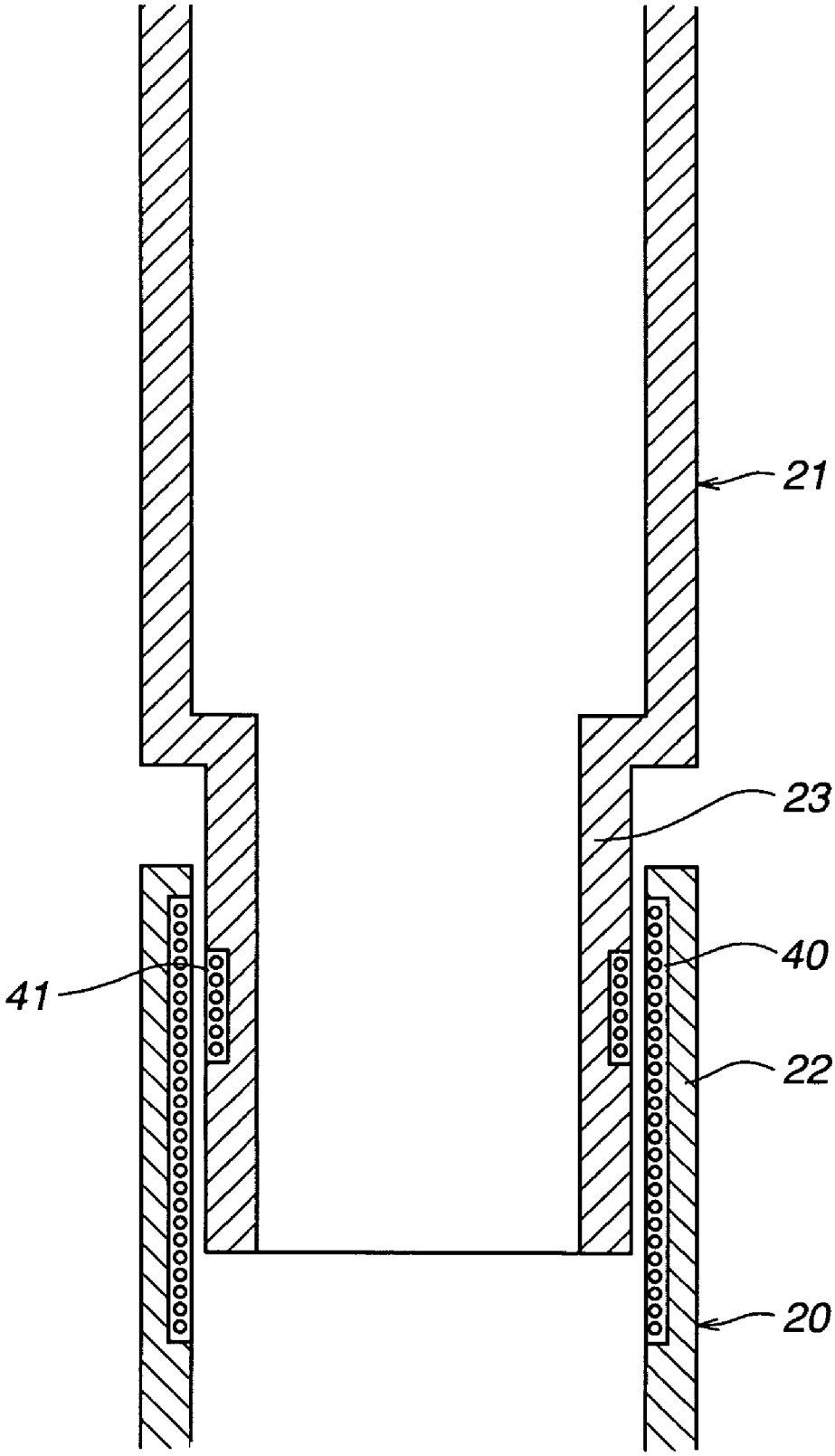
FIG. 3 shows a second embodiment of a device according to the invention for electrical coupling between a first and a second pipe section.

FIG. 3 shows another embodiment of the invention. The arrangement is the same as in FIG. 2 except that a long winding 40 is arranged on the inside of the end part 22 of the first pipe section 20 and a short winding 41 is arranged on the outside of the end part 23 of the second pipe section 21. The windings 40 and 41 are recessed into the walls of the end parts 22 and 23.

This concept has been tested in laboratory using actual production pipes. A long winding, with a length of approximately 1 meter and 400 turns, was affixed to the inside of a polished bore receptacle of a first pipe section and a smaller pick-up coil, approximately 0.2 meter and 30 turns was attached to the outside of a seal stinger of a second pipe section. DC resistance was measured to be 44.5 ohm for the long winding and 0.8 ohm for the short winding.

It was established that electric power can indeed be transferred and high frequency signals can be transferred, up to approximately 500 kHz.

The present invention is not limited to the embodiments disclosed but may be varied and modified within the scope of the following claims. For example in an embodiment of the invention the sensor is supplied with direct current and a DC/AC converter is connected before and an AC/DC converter is connected after the inductive coupler. The same coupling principle may also be used to make downhole electronic modules (DEM) exchangable on wire-line. The DEM would then be placed in a side pocket mandrel or equivalent with windings in the mandrel and the side pocket respectively.

The invention claimed is:

1. A device for electrical coupling between a first and a second pipe section mechanically coupled to each other and forming a pipe adapted for transportation of oil and/or gas in a wellbore, wherein the first pipe section comprises a first electric winding and the second pipe section comprises a second electric winding and said first and second windings are adapted for inductive coupling between the first and the second pipe section, wherein the first and the second windings are arranged so that they at least partially overlap each other in the axial direction when the first and the second pipe section are mechanically coupled to each other and wherein one of the windings has an essentially longer axial extension than the other winding.

2. The device according to claim 1, whereby the second pipe section comprises an end part adapted for mechanical coupling to the first pipe section and the first pipe section comprises an end part adapted for receiving said end part of the second pipe section, wherein the first electrical winding is arranged at said end part of the first pipe section and the second electrical winding is arranged at said end part of the second pipe section.

3. The device according to claim 1, wherein the first pipe section comprises a first electrical wire and the second pipe section comprises a second electrical wire and wherein said windings are arranged for inductive coupling between the first and the second electrical wire.

4. The device according to claim 2, wherein the diameter of the end part of the first pipe section is larger than the end part of the second pipe section and that the first winding is arranged on the inside of the end part of the first pipe section and the second winding is arranged on the outside of the end part of the second pipe section.

5. The device according to claim 1, wherein the length of the axial extension of the longer winding is substantially corresponding to the axial positioning tolerance for the mechanical coupling between the first and the second pipe section.

6. The device according to claim 5, wherein the length of the axial extension of the longer winding is in the interval 0.1–6 m.

7. The device according to claim 1, wherein at least one of the first and the second winding is recessed into the wall of the end part of any of the first or the second pipe section.

8. The device according to claim 1, wherein the first and the second winding are insulated.

9. The device according to claim 1, wherein the device is adapted for transferring electric power between the first and the second pipe section.

10. The device according to claim 1, wherein the device is adapted for transferring signals for monitoring and/or controlling the condition in the pipe, between the first and the second pipe section.

11. The device according to claim 1, wherein said pipe is adapted for transportation of oil and/or gas in a sub sea well.

12. The device according to claim 1, wherein one of the windings is arranged in a polished bore receptacle and the other winding is arranged in a corresponding seal stinger.

13. A method for transferring electric power and/or sensor signals between a first and a second pipe section at least partially overlapping each other in an axial direction and mechanically coupled to each other and forming a pipe adapted for transportation of oil and/or gas in wellbore, the method comprising:

transferring alternating current between a first and a second pipe section by means of an inductive coupling.

14. The method according to claim 13, wherein the alternate current is transferred between a first electric winding arranged in the first pipe section and a second electric winding arranged in the second pipe section.

15. The method according to claim 13, wherein the sensor signals are transferred by means of a high frequency carrier superimposed upon the electric power transmission.

* * * * *